US005357731A

United States Patent [19]

Conway et al.

[11] Patent Number: 5,357,731

[45] Date of Patent: Oct. 25, 1994

[54] PACKAGING MACHINE

[75] Inventors: Graham Conway; Jeffrey Bloomfield; Oliver F. Chastney, all of Norfolk, England

[73] Assignee: Datum Appropriate Technology Limited, Norwich, United Kingdom

[21] Appl. No.: 891,656

[22] Filed: May 29, 1992

[30] Foreign Application Priority Data

May 30, 1991 [GB] United Kingdom ..... 9111635

[51] Int. Cl.[5] ..... B65B 51/16

[52] U.S. Cl. ..... 53/374.4; 53/374.3; 53/375.4; 53/553; 493/208; 493/475; 493/478

[58] Field of Search ..... 53/373.2, 374.3, 374.4, 53/553, 554, 555, 371.4, 375.4; 493/206, 207, 208, 475, 478

[56] References Cited

U.S. PATENT DOCUMENTS

| | | | |
|---|---|---|---|
| 2,253,036 | 8/1941 | Kimple et al. | 53/374.4 X |
| 2,419,982 | 5/1947 | Zwoyer | 53/554 X |
| 2,637,959 | 5/1953 | Dreher | 53/555 |
| 3,191,356 | 6/1965 | Zelnick et al. | 53/555 |
| 3,552,088 | 1/1971 | Niwa | 53/374.4 X |
| 3,625,802 | 12/1971 | Schniepp | 53/374.4 X |
| 3,824,908 | 7/1974 | Rowell | 53/553 X |
| 4,164,833 | 8/1979 | Todd | 53/374.4 X |
| 4,202,721 | 5/1980 | Roberts | 53/374.4 X |
| 4,214,419 | 7/1980 | Allen et al. | 53/553 X |
| 4,219,988 | 9/1980 | Shanklin et al. | 53/374.4 X |
| 4,369,613 | 1/1983 | Gess | 53/553 |
| 4,376,365 | 3/1983 | Moertel | 53/555 |
| 4,829,746 | 5/1989 | Schmidt et al. | 53/374.4 X |

FOREIGN PATENT DOCUMENTS

| | | | |
|---|---|---|---|
| 401137 | 12/1990 | European Pat. Off. | 53/553 |
| 2629790 | 10/1989 | France | 53/374.4 |

*Primary Examiner*—John Sipos
*Assistant Examiner*—Daniel Moon
*Attorney, Agent, or Firm*—Collard & Roe

[57] ABSTRACT

A four-sided seal packaging machine having a side sealing unit, an end sealing unit, and an end cutting unit. The side sealing unit has a frame work, a first pair of cooperative sealing members to seal a first longitudinal edge of a package as the package is formed and a second pair of cooperative sealing members to seal an opposing longitudinal edge of the package. The first pair and the second pair of sealing members are mounted independently of each other to the frame work and each pair has a respective adjustment for adjusting the extent of compression together of the members of that pair independently of the other pair. The machine is well adapted for enabling self-validation, providing reliable high integrity seals.

5 Claims, 3 Drawing Sheets

PACKAGING MACHINE

FIELD OF THE INVENTION

The present invention relates to a packaging machine, and more particularly to a four-sided seal packaging machine.

BACKGROUND OF THE INVENTION

Packaging for surgical dressings and like medical applications needs to be of reliable high quality with a virtually guaranteed airtight seal whilst being easy to open rapidly, as required in an emergency situation. Packaging machines best suited for wrapping medical applications employ a four sided sealing technique whereby each product is deposited between two webs of packaging material which are sealed along the longitudinal edges of the product (those edges extending longitudinally of the production line) and transversely at each end of the product. Ease of opening of such packages is assisted by provision of gaps or "skips" in the longitudinal seals of each package beyond the end seals of the package. Ease of opening may be further enhanced by provision of a thumb notch in one of the webs of the packaging.

Validation of the process for packaging medical applications is essential and the complexity of the packaging process makes self-validation or autoregulation of such machines difficult. Quality control criteria are exceptionally high and quality control is time consuming when carried out by the standard technique of batch testing of the packaged products.

Seal integrity must be ensured. To achieve this through the design of the machine the conditions effecting seal integrity must be controlled within strict parameters. The pressure of compression together of the edges of the webs of material to be welded is one such condition that must be strictly controlled. The rate of package production and, where the welding is by heating of thermo plastic material, the temperature of the welding elements are two other such conditions.

In conventional horizontal flow four-sided seal packaging machines the longitudinal edges of the packages are sealed by co-acting pairs of vertically-spaced rollers which compress together to weld the webs of packaging material together. A respective set of such rollers is provided to weld the left hand and right hand longitudinal edges of the packages on the production line. The upper rollers for the right and left hand edges are generally interconnected by one axle shaft, while the lower rollers for the right and left hand edges are inter-connected by a further shaft. This arrangement and the manner by which the co-acting pairs of rollers are advanced and retracted relative to each other to adjust the pressure of compression presents considerable problems in reliably controlling the pressure of compression and, hence, seal integrity.

It is a general objective of the present invention to provide a four-sided seal packaging machine which is capable of reliably producing packages of high quality and high seal integrity.

SUMMARY OF THE INVENTION

According to the present invention there is provided a four-sided seal packaging machine which comprises: a side sealing unit; an end sealing unit; and an end cutting unit, the side sealing unit having a frame work, a first pair of co-operative sealing members to seal a first longitudinal edge of each package as the package is formed and a second pair of co-operative sealing members to seal an opposing longitudinal edge of each said package, the said first pair and the said second pair being mounted independently of each other to the frame work and each said pair having a respective adjustment means for adjusting the extent of compression together of the members of that pair independently of the other pair.

Preferably the adjustment means is provided with adjustable mechanical stop means whereby the extent of compression together of the sealing members of the respective pair may be adjusted in known repeatable steps.

Suitably the adjustment means comprises a cam and an operatively associated cam follower, the cam having a range of stop surfaces against which the cam follower may be detained, in use.

Advantageously the first pair of co-operative sealing members is mounted to a first portion of the frame work and the second pair of co-operative sealing members is mounted to a second portion of the frame work, the first portion of the frame work and the second portion of the frame work being slidably inter-linked to enable the lateral separation of the first and second portions to be altered to accommodate different widths of package.

To particular advantage the adjustment means may incorporate means enabling the side sealing unit to form skips in the side seals.

Suitably the side sealing unit has a product support bed which extends substantially the length thereof and which is externally vertically adjustable to accommodate products of differing vertical thickness.

The end sealing unit and the end cutting unit may be longitudinally spaced from each other by a distance greater than the smallest dimension of the packages.

BRIEF DESCRIPTION OF THE DRAWINGS

A preferred embodiment of the present invention will now be more particularly described by way of example and with reference to the accompanying drawings wherein.

DESCRIPTION OF THE PREFERRED EMBODIMENT

Figure 1:
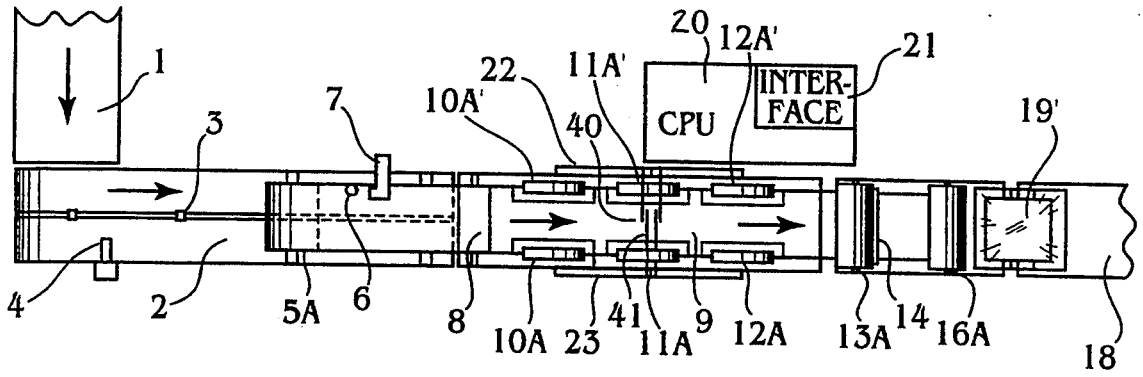
FIG. 1 is a schematic top plan view of a machine embodying the present invention and illustrating an upper web of packaging material extending through the machine.

As shown in FIG. 1, the machine comprises a motorised in-feed conveyor 2 supplied with products at a constant rate from a product supply line 1. Each product item registers against an indexing lug 3 and is advanced towards the main body of the wrapping machine. Presence of a product 19 on the conveyor 2 is detected by a proximity sensor 4, information from which is assessed by a micro processor unit and fed also to a central processing unit 20 for use in the integrated control of the machine.

Figure 2:
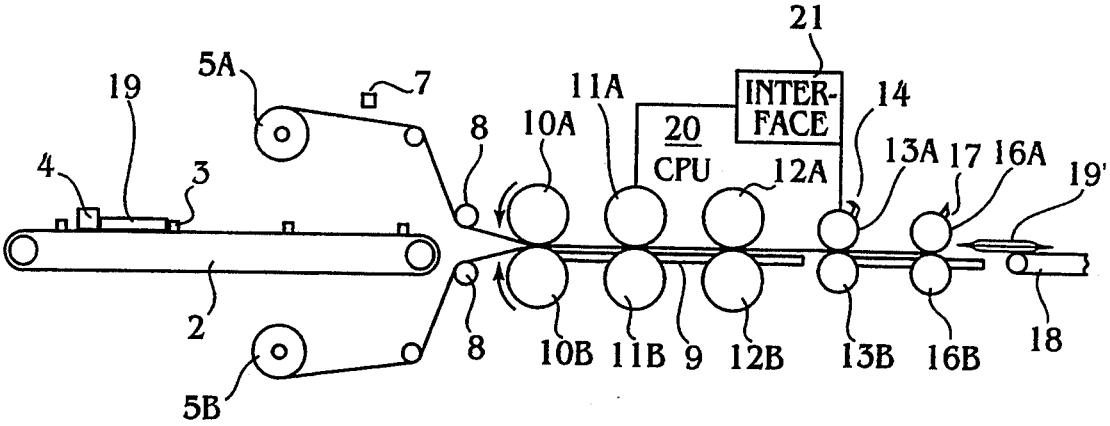
FIG. 2 is a schematic side elevation of the machine of FIG. 1.

The two webs of wrapping material (thermo-plastic or cold seal) which make up each individual package are supplied from a pair of reels 5A, 5B, one mounted above the conveyor 2 and the other mounted below. The two webs are channelled together by a substantially parallel and horizontal pair of guide rollers 8. In use the product, indicated at 19 on FIG. 2, is propelled into a position between the upper and lower packaging webs by the conveyor 2 after which the edges of the packaging surrounding the product 19 are sealed together by the various sealing members of the machine.

Prior to sealing of the edges, the longitudinal edges of the webs are advanced through the machine by two pairs of vertically compressed drive wheels, each vertically compressed pair of drive wheels 10A, 10B being located on an opposite longitudinal edge of the web. Advancement of the web drags the product 19 forwardly also, support for the product being provided by a support bed 9 extending longitudinally of the web (or product line) between the two sets of vertically paired drive wheels 10A, 10B.

Sealing of the longitudinal edges of the upper and lower webs to encase the product 19 is effected by two sets of vertically paired heated wheels 11A, 11B, and 11A', 11B', each set being located on a respective opposite longitudinal edge of the web in a manner equivalent to that of the drive rollers 10A, 10B. The two sets of vertically paired longitudinal edge sealing, or "side sealing", wheels 11A, 11B and 11A', 11B' are duplicated further downstream of the production line as indicated at 12A, 12B on FIG. 2. The duplicate sets of side sealing rollers 12A, 12B ensure the quality of the side seals of the packages. The seals are formed by welding together of the upper and lower webs of thermo-plastics material under the heat and pressure from compression of the upper and lower pairs of heated side sealing wheels 11A, 11B and 12A, 12B.

The side sealing wheels 11A, 11B and 12A, 12B are all driven, in use. A gear train is provided to rotate all of the side sealing wheels 11A, 11B, 12A, 12B and the drive wheels 10A, 10B under power of a single servo motor (not shown).

The drive wheels 10A, 10B and side sealing wheels 11A, 11B and 12A, 12B positioned along one side (longitudinal edge) of the production line essentially form a mirror image of the corresponding wheels on the opposite side of the product line. The wheels 10 to 12 of one side of the production line are mounted to a module frame 23, the wheels 10' to 12' of the other side of the production line being mounted to a respective module frame 22. The opposing module frames 22 and 23 are adjustably separated by means of a screw mechanism or other suitable mechanism 40, 41 extending beneath the product support bed 9 between the two module frames 22 and 23. The independent construction of the module frames 22 and 23 and the screw mechanism enables precise control of adjustment of the spacing of the laterally opposing wheels when accommodating differing widths of product and packaging web and provides independent suspension for the laterally opposing pairs of wheels 11A, 11A' and 11B, 11B'. This arrangement avoids prior art problems associated with heat congealing of the side sealing rollers when the members of laterally opposing pairs are mounted on a common axle. Further more, this arrangement enables convenient adjustment for machine's set up including, in particular, the extent of compression together of the co-acting wheels 11A, 11B and 12A, 12B in operation, giving continued repeatability of seal integrity without need to revalidate the machine.

The machine is adapted to provide a "skip" seal facility whereby the upstream side sealing rollers 11A, 11B are intermittently momentarily raised from contact with the webs. The downstream sets of side sealing wheels, or rollers, 12A, 12B are raised after sufficient time lag for the portion of the webbing which had been skipped by the upstream wheels 11A, 11B to reach the downstream wheels 12A, 12B.

Figure 4:
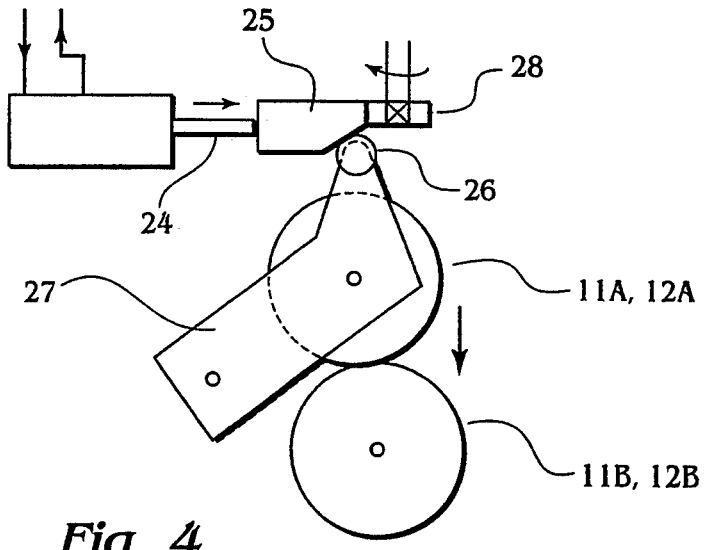
FIG. 4 is a schematic side elevation of a pressure adjusting mechanism and skip control facility for the side sealing unit of the machine of FIG. 1.

The mechanism for effecting the skip function comprises a solenoid operated actuating arm 24 or a piston which antagonises a spring to press one of a pair of vertically spaced wheels 11A, 12B or 12A, 12B against the other of the pair. The mechanism is illustrated in FIG. 4. The actuating arm 24 urges a wedge 25 against a cam follower 26. The cam follower 26 is mounted at the free end of a rocker arm 27 to which, in turn, an upper side sealing roller 11A or 12A is rotatably mounted. The upper roller 11A, 12A presses against the lower roller 11B, 12B welding together the longitudinal edges of the webs sandwiched there between during such time as the actuating arm 24 is in its fully extended position. Intermittent retraction of the actuating arm 24 retracts the wedge 25 allowing the cam follower 26 to rise relative to the lower roller 11B, 12B allowing the upper roller 11A, 12A to correspondingly rise away from the lower roller 11B, 12B.

A further facility is provided on the skip control mechanism to enable the compression of the upper and lower rollers 11A, 11B or 12A, 12B to be adjusted. This facility comprises a cam head 28 having a number of different cam surfaces each of which can act as the stop surface to halt advancement of the wedge 25 under action of the actuating arm 24. Selection of a different cam surface of the cam head 28 enables the wedge 25 to advance to a greater or lesser extent which, in turn, depresses the cam follower 26 correspondingly, thereby altering the degree of compression of the upper roller 11A or 12A against the lower roller 11B or 12B.

Figure 5:
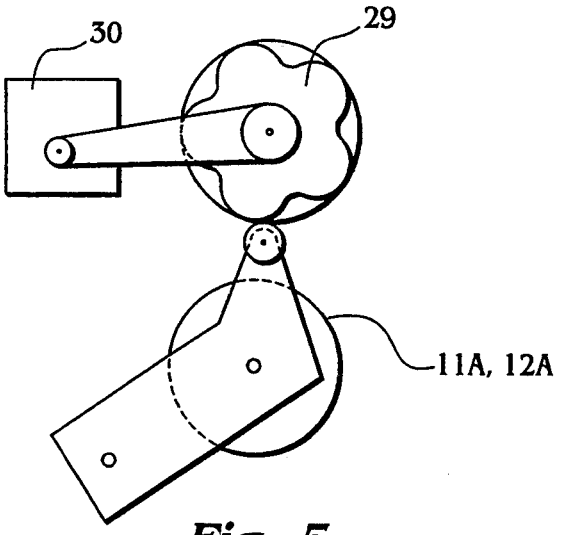
FIG. 5 is an alternative arrangement of pressure adjusting mechanism to that illustrated in FIG. 4.

An alternative version of the pressure adjusting facility of FIG. 4 is illustrated in FIG. 5. In this arrangement the actuating arm 24 and wedge 25 are omitted and replaced by a single cam member 29 which incorporates at least one recess of sufficient depth to enable the cam follower 26 to rise sufficiently to provide a skip facility, separating the rollers 11A, 12A from contact with the edge of the upper web. The cam member 29 is, therefore, relied upon to perform a dual function-pressure adjustment and skip generation. The stopper motor 30 used to rotate the cam member 29 is, therefore, in use throughout operation of the machine.

Figure 6:
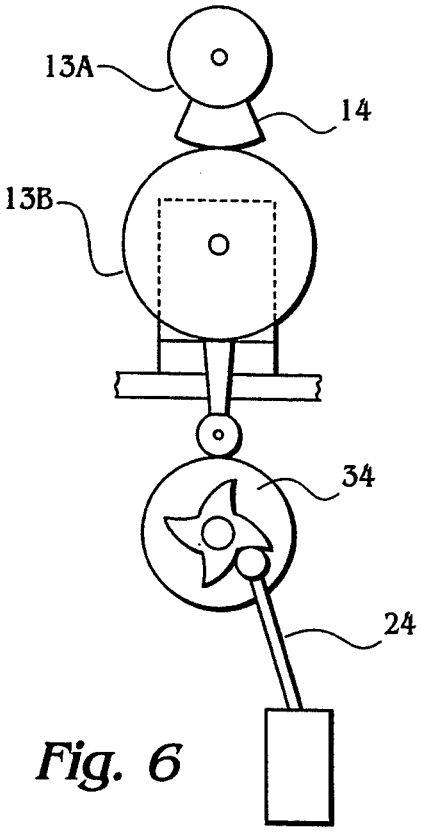
FIG. 6 is a pressure adjusting mechanism for the end sealing unit of the machine of FIG. 1.

Referring again to FIGS. 1 and 2, downstream of the side sealing roller assembly is a member for sealing the packages transversely at each longitudinal end of each package. The transverse sealing, or end sealing, member comprises an upper roller 13A having a jaw 14 projecting radially therefrom and extending longitudinally thereof transverse to the production line. In common with the side sealing rollers 11, 12, the steel jaw 14 of the upper end sealing roller 13A is heated to achieve the necessary weld temperature and co-acts, in use, with a lower roller 13B. The lower roller, or anvil, 13B is preferably composed of silicon rubber. Again in common with the side sealing rollers 11, 12, the end sealing roller pair 13A, 13B is adjustable in vertical separation to adjust the sealing pressure. A suitable mechanism for this purpose is illustrated in FIG. 6. It will be appreciated that the mechanism for the end sealing unit 13A, 13B resembles the mechanism illustrated in FIG. 4. No skip facility is required for the end sealing unit 13A, 13B and, therefore, the actuating arm 24 is used to directly rotate a cam 34 for moving the cam follower to increase or decrease the separation of the upper and lower end sealing rollers 13A and 13B in known repeatable steps.

Rotation of the upper end sealing roller 13A is effected by a servo motor (not shown) independent from that used for powering the drive rollers 10 and side sealing rollers 11, 12.

The fully packaged product 19' emerging from the end sealing unit 13A, 13B is severed from attachment to the upstream packaging material by action of an end cutting unit comprising an upper roller 16A extending transversely of the production line and having a blade 17 projecting radially therefrom and extending the length of the upper roller 16A. The end cutter unit further comprises a lower roller 16B serving as an anvil against which the blade 17 presses, in use.

Like the end sealing unit 13A, 13B the end cutter unit 16A, 16B is powered by its own servo motor (not shown).

The fully packaged product 19' exiting the main body of the machine is carried away by a discharge conveyor 18. A special feature of the discharge conveyor 18 is the provision of a reject facility which comprises a portion of the conveyor 18 which rises like a trap-door to allow reject packaged products or lengths of packaging material to drop from the line of discharged packaged products.

Figure 3:
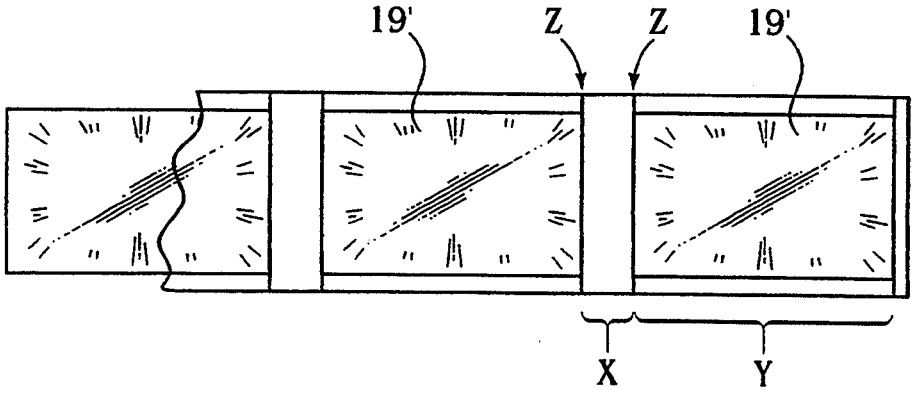
FIG. 3 is a plan view of a line of packaged products following end sealing and prior to separation of the individual wrapped products by the machine's cutting element.

The format of packaged products upon completion of side and end sealing is illustrated in FIG. 3. Individual packages have their longitudinal edges sealed as indicated at Y while gaps, or skips, X are left between the end seals Z demarcating each package 19'. The blade 17 of the end cutter unit 16A, 16B is synchronised in use to sever the portion of packaging material between adjacent end seals Z. The absence of side seals for the interval X between these two end seals Z facilitates peeling apart of the two webs of the package when the contents of the package are to be used.

Figure 7:
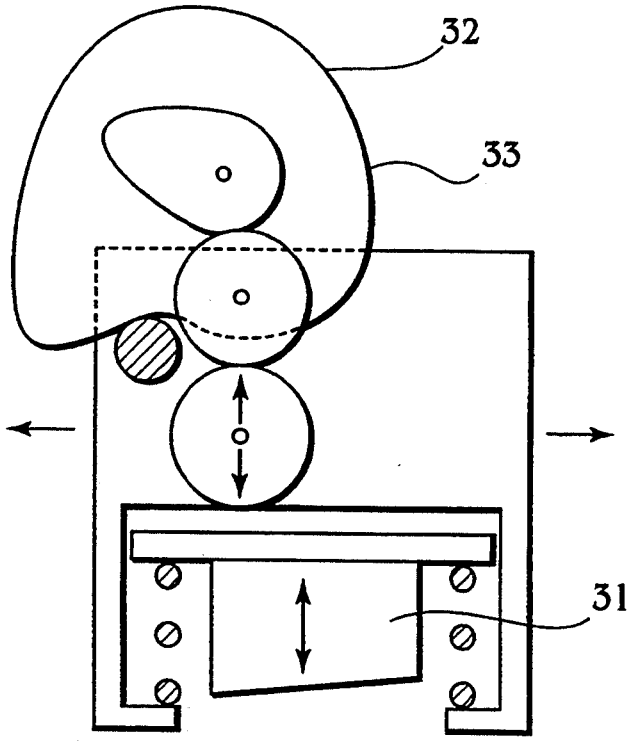
FIG. 7 is a schematic side elevation of a notch cutting unit suitable for use with the machine of FIG. 1.

Ease of opening of each package may be improved by provision of a thumb notch at one end of the package. A suitable unit for carrying out this function in the packaging machine is illustrated in FIG. 7. This notcher unit cuts off one corner of the upper web of packaging material before the upper and lower webs are merged through the guide rollers 8. The notcher unit comprises a die 31 which is spring-biassed away from the web to be cut but intermittently pressed into contact with the web by a primary cam 32. The die 31 punches a triangle from one longitudinal edge of the web while being transported longitudinally with the web at a rate simultaneous with the rate of advancement of the web so as to avoid tearing of the web. The secondary cam 33 then resets rapidly to its original position before commencing further notching actions.

Reliable operation of packaging machines requires that all of the various functions are suitably synchronised. Furthermore, auto-regulation of the packaging process requires provision of means for monitoring the status of the various parameters of the machine and means for re-adjusting those parameters as necessary.

The control mechanism of the present invention which is responsible for coordination of operating enabling auto-regulation will now be described in detail.

As mentioned above, each of the product in-feed conveyor 2, the drive and side sealing roller unit 10, 11, 12, the end sealing unit 13 and the end cutting unit 16 is powered by its own servo motor. These independent servo motors enable the respective packaging units to be independently readjusted, particularly if faults should be detected upstream. The servo motor of each unit is provided with its own dedicated micro processor for enabling closed loop control in readjustment of that unit. Overall programming and operator control is provided by a central processing unit 20 having a touch screen panel 21 providing an interface for human operators.

A range of sensors are provided throughout the machine for monitoring the important parameters affecting the quality of product output by the machine. These parameters include flow rate and synchronisation of the various operating members, temperature of the heated sealing rollers 11, 12, 13 and pressure exerted between those rollers, in use.

The in-feed conveyor 2 has, as previously stated, a proximity sensor 4 for detecting the passage of an indexing lug 3 therepassed. Additionally the in-feed conveyor 2 has a proximity sensor (not shown) located near its downstream end for detecting passage of a product 19 therepassed.

The rate of supply of the upper web of wrapping material from upper reel 5A is monitored by a print registration unit 7 detecting passage of print indexing marks 6 on the web passed the photo electric eye of the sensor 7.

The end seal unit 13 and end cutter unit 16 each have a respective proximity sensor (not shown) respectively to detect the presence of the jaw 14 or knife 17 at a specific locus on the rotary path of that member 14, 17.

In addition to the aforementioned sensors, each of the servo motors referred to above is provided with an en-coder for providing continuous data to the micro processors and central processing unit 20 of the angular position and hence rate of revolution of the respective motor.

The temperature of each of the sealing wheels 11, 12, 13 is monitored by a resistance thermometer buried within the respective wheel (or jaw 14, in the case of the upper end sealing roller 13A). An accurate indication of the surface temperature of the sealing members, which is the parameter to be monitored, can be obtained by programming the central processing unit 20, re-calibrating the output of the sensor to account for the difference in temperature between the interior of the sealing member 11, 12, 13 and the external surface thereof.

The factor of pressure influencing the seal integrity may be monitored directly by pressure sensors or indirectly by use of sensors to detect the vertical separation of the surfaces of sealing members 11, 12, 13 which press together, in use of the sealing members.

One method of operation of the machine will now be described in detail.

Because commencing a packaging run the in-feed conveyor 2, the printed upper wrapping web, the end sealing jaw 14 and the end cutting knife 17 are all indexed by the respective proximity sensors and the print registration unit 7. The rate of advancement of the in-feed conveyor 2 and the rate of revolution of the drive rollers 10, the end sealing rollers 13 and the end cutter rollers 16 are set according to parameters input into the central processing unit by the operator interface 21. The central processing unit has memory capacity to store a wide range of parameters relevant to different package specifications. Target sealing temperatures and pressures may all be pre-set to suit differing thickness of packaging web and differing rates of throughput.

The length of each package to be formed dictates the rate at which the end seal jaw 14 and end seal cutter 17 revolve into contact with the packaging material relative to the rate at which the drive rollers 10 propel the packaging and entubed products through the machine.

As the packaging run commences the print registration unit 7 provides wrapping feed rate data which is used to moderate the rate of revolution of the drive wheels 10A, 10B. The micro processor associated with the drive and side sealing unit 10, 11, 12 calculates from the print registration unit 7 data whether or not the intervals between actuation of the skip mechanism require re-adjusting from their pre-programmed state. If the wrapper feed rate increases then the rate of skip mechanism actuation needs to increase correspondingly.

The end seal unit 13 and end cutter unit 16 are adjusted in line with changes in the rate of wrapper feed also.

Data provided by the coders on the servo motors to each unit of the machine is processed to give an indication of inconsistencies in rate of revolution of the respective motors. If, for example, rate of revolution of the servo motor to the end sealing unit 13 is slower than the pre-programmed rate of revolution, then the micro processor to that servo motor will compare the actual rate data with the pre-programmed rate data and the central processing unit 20 will determine which unit of the machine is at fault and instigate the necessary corrective measures. The end cutter unit 16 is slaved to the end sealing unit 13 and its rate of revolution will be adjusted to be in appropriate synchrony with the end sealing unit 13.

If the upper wrapping web is not printed then there will be no data from the print registration unit and, therefore, the data from the servo motors will be relied upon to regulate the machine.

Throughout operation of the machine the in-feed product proximity sensor will continuously monitor product flow enabling the micro processor associated with the servo motor of the in-feed conveyor 2 to detect product absence or mis-positioning on the in-feed conveyor 2.

The self regulation of the machine is sufficiently reliable that there is negligible risk of jamming of the machine and occurrence of defective products. Should defects occur these are automatically removed via the reject facility in the discharge conveyor 18. The packages in the machine on start up of the machine will automatically be rejected, when the CPU 21 has calculated the length of material involved.

Should a major fault occur the machine will automatically shut down and, in doing so, separate the upper and lower sets of rollers to enable jams to be cleared manually.

Should the temperature sensors buried in the sealing members 11, 12, 13 detect sub-standard temperatures for sealing then the packaging run will be halted until these members heat up to the required temperatures. On restarting the machine will automatically reject those packages which were trapped during the period of rest.

In addition to regulating sealing temperature to ensure seal integrity, the machine also monitors and controls sealing pressure by the mechanisms illustrated in FIGS. 4 to 6. Further control over seal quality is provided in the form of a dwell control that enables the period of sealing contact of the end sealing jaw 14, in particular, to be varied within limits that do not interrupt the rate of flow of the packaging run. This dwell facility acts to lengthen or shorten the period of contact while respectively correspondingly quickening or slowing the angular velocity of the end sealing jaw 14 through that part of its cycle which is out of contact with the web.

Although the present invention has been described primarily with respect to one preferred embodiment numerous alternative embodiments will be evident to the skilled reader. The term "four-sided seal packaging" as used herein is not limited to packaging systems in which the webs or packaging material are both supplied in sheet form. One or both of the webs may be thermoformed to provide an appropriately shaped receptacle for the article to be packaged. A thermo-forming device may be mounted to the in-feed of the machine of the present invention.

We claim:

1. An apparatus for sealing a wrapping around an item, the item having two spaced opposite, longitudinal edges and two ends, comprising:

An edge sealing unit including:

(i) a framework;

(ii) a first pair of cooperative sealing members mounted on said framework for sealing a longitudinal edge of the wrapping as the wrapping is formed around the item, said first pair being operatively compressed together to a selected extent of compression and having a first motorised adjustment means with mechanical stop means having at least three different stop positions adapted to adjust the extent of compression in pre-determined steps at least between two pre-determined levels of compression other than zero compression during sealing operation of the apparatus; and (iii) a second pair of cooperative sealing members mounted on said framework independently of said first pair of co-operative sealing members for sealing an opposed longitudinal edge of the wrapping, said second pair being operatively compressed together to a selected extent of compression and having a second motorised adjustment means with mechanical stop means having at least three different stop positions adapted to adjust the extent of compression in pre-determined steps at least between two pre-determined levels of compression other than zero compression during sealing operation of the apparatus; and an end sealing unit and end cutting unit for sealing and cutting the wrapping ends, wherein said first and second adjustment means each comprises a cam and an operatively associated cam follower, each of said cams having two or more cam stop surfaces with different heights to adjust the extent of compression between two or more pre-determined levels of compression other than zero compression.

2. The apparatus as claimed in claim 1, wherein said framework includes a first portion with first slidable coupling means and a second portion with second slidable coupling means latteraly spaced from said first portion, said first pair of cooperative sealing members being mounted to said first portion and said second pair of co-operative sealing members being mounted to said second portion, said first slidable coupling means co-operatively engaging said second slidable coupling means for relative movement thereto to adjust lateral separation of said first and second portions to accommodate items of different widths.

3. The apparatus as claimed in claim 1, wherein each of the said first adjustment means and said second adjustment means includes means enabling said edge sealing unit to discontinue sealing the longitudinal edge of the wrapping.

4. The apparatus as claimed in claim 1, wherein said edge sealing unit extends longitudinally and has an item support bed which extends substantially the whole longitudinal length of the apparatus said item support bed having an adjustor to raise or lower said item support bed to accommodate items of different heights.

5. The apparatus as claimed in claim 1, wherein said sealing unit and said end cutting unit are longitudinally spaced from each other by a distance greater than a smallest dimension of an item.

* * * * *